US007736184B1

(12) United States Patent
Wan et al.

(10) Patent No.: US 7,736,184 B1
(45) Date of Patent: Jun. 15, 2010

(54) RECEPTACLE CONNECTOR

(75) Inventors: Wei Wan, Hsin Tien (TW); Shu Lin Duan, Hsin Tien (TW); Ching Tien Chen, Hsin Tien (TW); Pin Yuan Hou, Hsin Tien (TW); Wen Chih Ko, Hsin Tien (TW)

(73) Assignee: Advanced-Connectek Inc, Taipei County (TW)

( * ) Notice: Subject to any disclaimer, the term of this patent is extended or adjusted under 35 U.S.C. 154(b) by 0 days.

(21) Appl. No.: 12/394,279

(22) Filed: Feb. 27, 2009

(30) Foreign Application Priority Data

Dec. 24, 2008 (TW) ..... 97223160 U

(51) Int. Cl.
*H01R 13/648* (2006.01)

(52) U.S. Cl. ..... 439/607.11

(58) Field of Classification Search ..... 439/607.11, 439/607.07–607.09, 607.32, 101, 676
See application file for complete search history.

(56) References Cited

U.S. PATENT DOCUMENTS

| | | | | |
|---|---|---|---|---|
| 7,563,140 | B1 * | 7/2009 | Wan et al. | 439/660 |
| 7,632,145 | B1 * | 12/2009 | Lin et al. | 439/607.32 |
| 7,670,199 | B2 * | 3/2010 | Nagata et al. | 439/101 |
| 7,682,163 | B2 * | 3/2010 | Hou et al. | 439/79 |
| 2009/0305532 | A1 * | 12/2009 | Hou et al. | 439/83 |

* cited by examiner

*Primary Examiner*—T C Patel
*Assistant Examiner*—Phuong Nguyen
(74) *Attorney, Agent, or Firm*—Rabin & Berdo, P.C.

(57) ABSTRACT

A receptacle connector comprises an insulated housing, plural first contact pins, plural second contact pins and a metal casing. The first contact pin complies with a USB 3.0 interface, comprises a contact pin, a connected portion, a second contact pin and an arch and mounts parallel with the first terminal on the insulated housing. The second contact pin complies with a USB 2.0 interface, comprises a protruded end, an elongated portion and a first pin and mounts on the insulated housing. The metal casing mounts around the insulated housing. The receptacle connector transmits data steady at a high transmission rate.

3 Claims, 9 Drawing Sheets

RECEPTACLE CONNECTOR

FIELD OF THE INVENTION

The invention relates to a receptacle connector, and more particularly, a receptacle connector complies with USB 2.0 and USB 3.0 specifications.

BACKGROUND OF THE INVENTION

A Universal Serial Bus (USB) is a hot-swap type transmission interface widely used in computer peripherals, connects to hardware to a computer and transmits information without rebooting the computer. In 1998, a USB 1.1 transmission interface was first released. In 2007, Intel Corp. released a USB 2.0 transmission interface allowing the USB interface to be used with more applications including flash drives, printers and mice and having a transmission rate of 480 Mbps, about 40× times faster than the USB 1.1 interface.

As computers have become increasingly powerful and able to process larger amounts of data, computers and computer peripherals have had to be able to transfer more and more data. Transmission efficiency of a USB 2.0 interface is limited by file size that has promoted development of a USB 3.0 interface. The USB 3.0 interface has all the capabilities of the USB 2.0 interface but has more advantages such as lower power consumption and higher transmission rate.

SUMMARY OF THE INVENTION

The objective of the present invention is to provide a receptacle connector complies with USB 2.0 and USB 3.0 specifications and provides stable transmission at high transmission rates.

A receptacle connector in accordance with the present invention incorporates USB 2.0 and USB 3.0 interface capabilities and comprises an insulated housing, five first contact pins, four second contact pins and a metal casing. The first pin complies with a USB 3.0 interface standard, comprises a contact, a connected portion, a second pin and an arch and mounts parallel to the first terminal on the insulated housing. The second contact pins complies with a USB 2.0 interface standard, comprises a protruded end, an elongated portion and a first pin mounted on the insulated housing. The metal casing mounts around the insulated housing. The receptacle connector transmits data steady at a high rate.

DESCRIPTION OF THE PREFERRED EMBODIMENT

Figure 1:
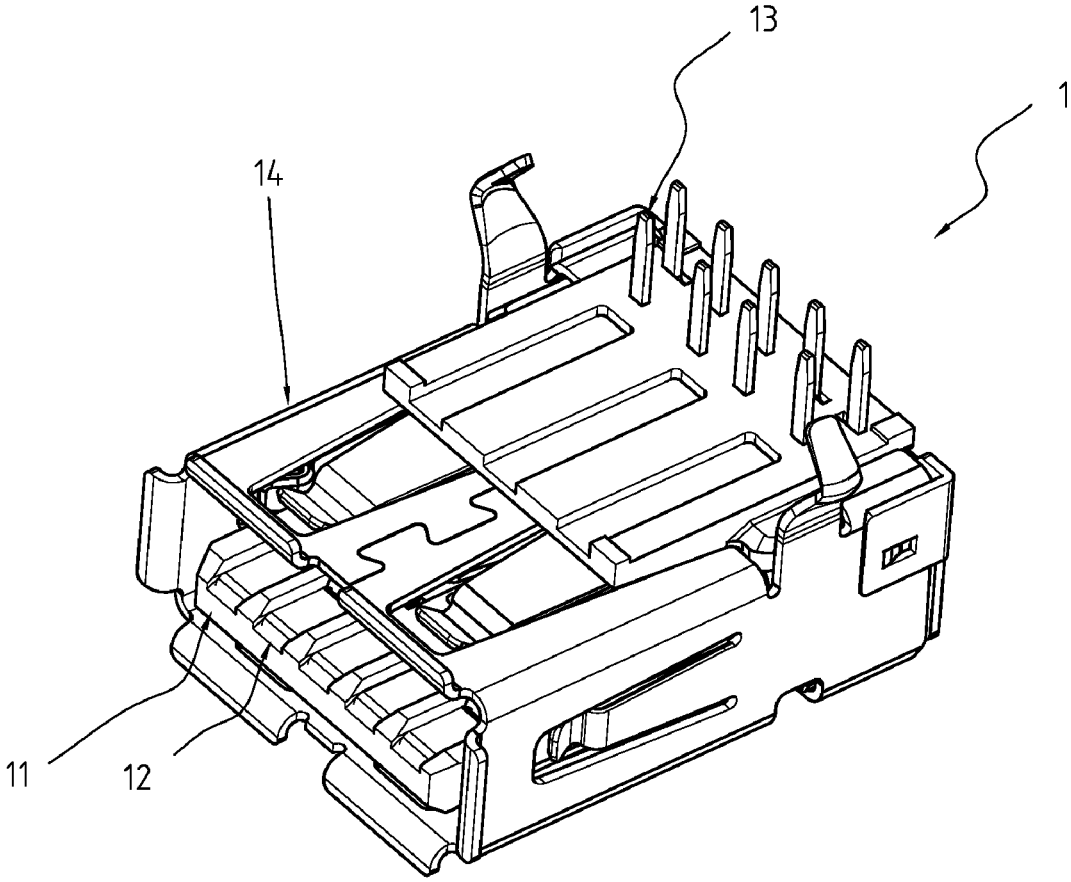
FIG. 1 is a front, bottom perspective view of a receptacle connector in accordance with the present invention.

With reference to FIG. 1, a receptacle connector (1) in accordance with the present invention corresponds to a plug, is mounted on a printed circuit board (PCB) and comprises an insulated housing (11), five first contact pins (12), four second contact pins (13) and a metal casing (14).

Figure 2:
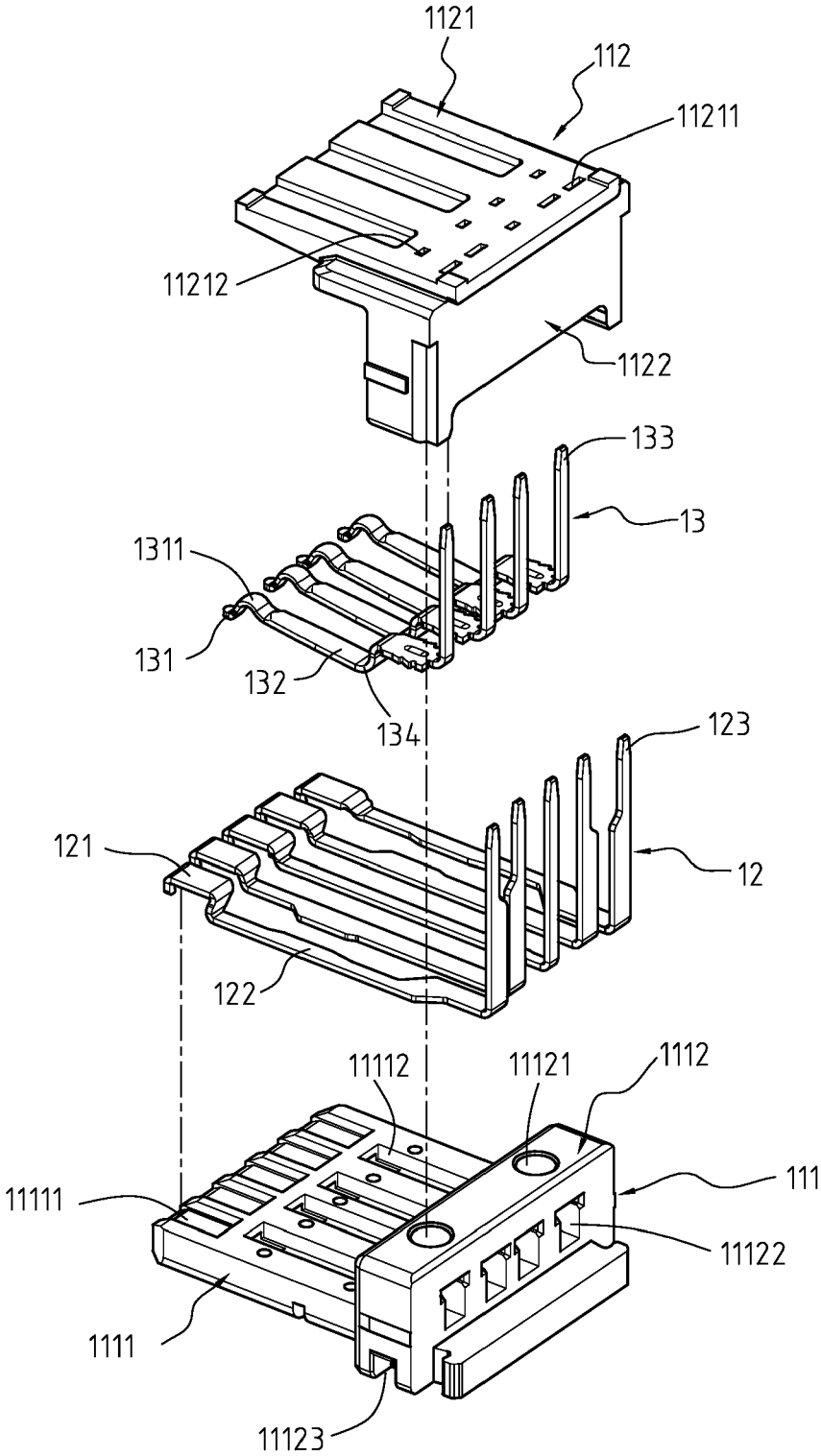
FIG. 2 is an exploded rear, bottom perspective view of the receptacle connector in FIG. 1 without a casing.

With further reference to FIG. 2, the insulated housing (11) comprises an upper housing (111) and a lower housing (112).

Figure 3:
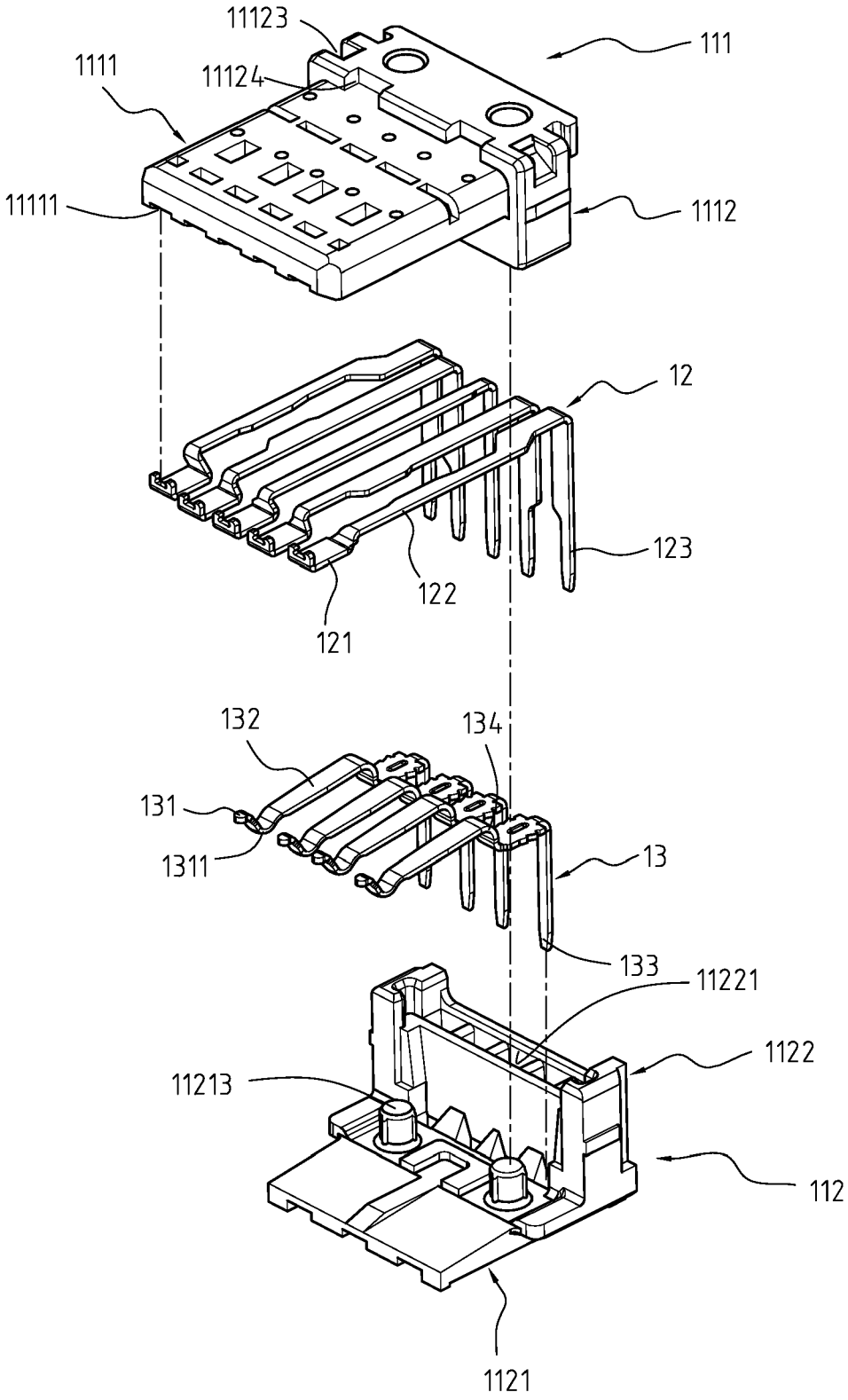
FIG. 3 is an exploded front, top perspective view of the receptacle connector in FIG. 2.
Figure 4:
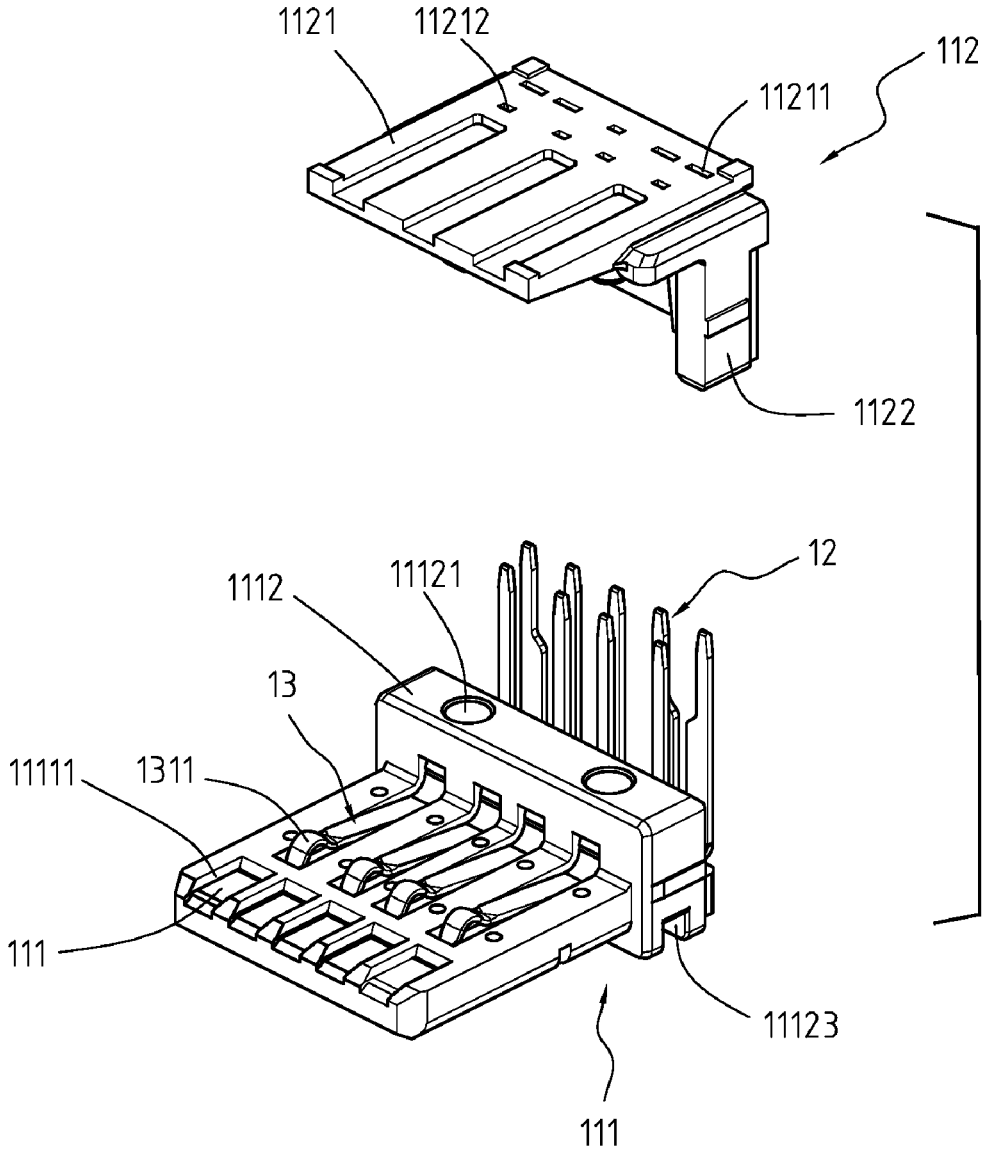
FIG. 4 is a partially exploded front, bottom perspective view of the receptacle connector in FIG. 2.
Figure 5:
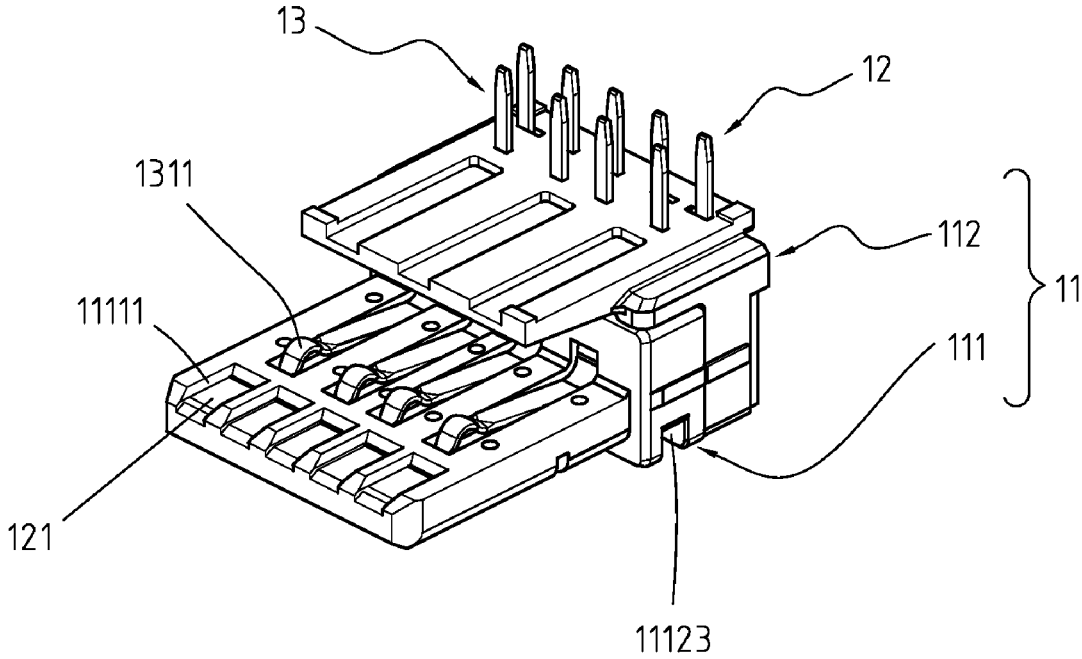
FIG. 5 is a perspective view of the receptacle connector in FIG. 2.
Figure 6:
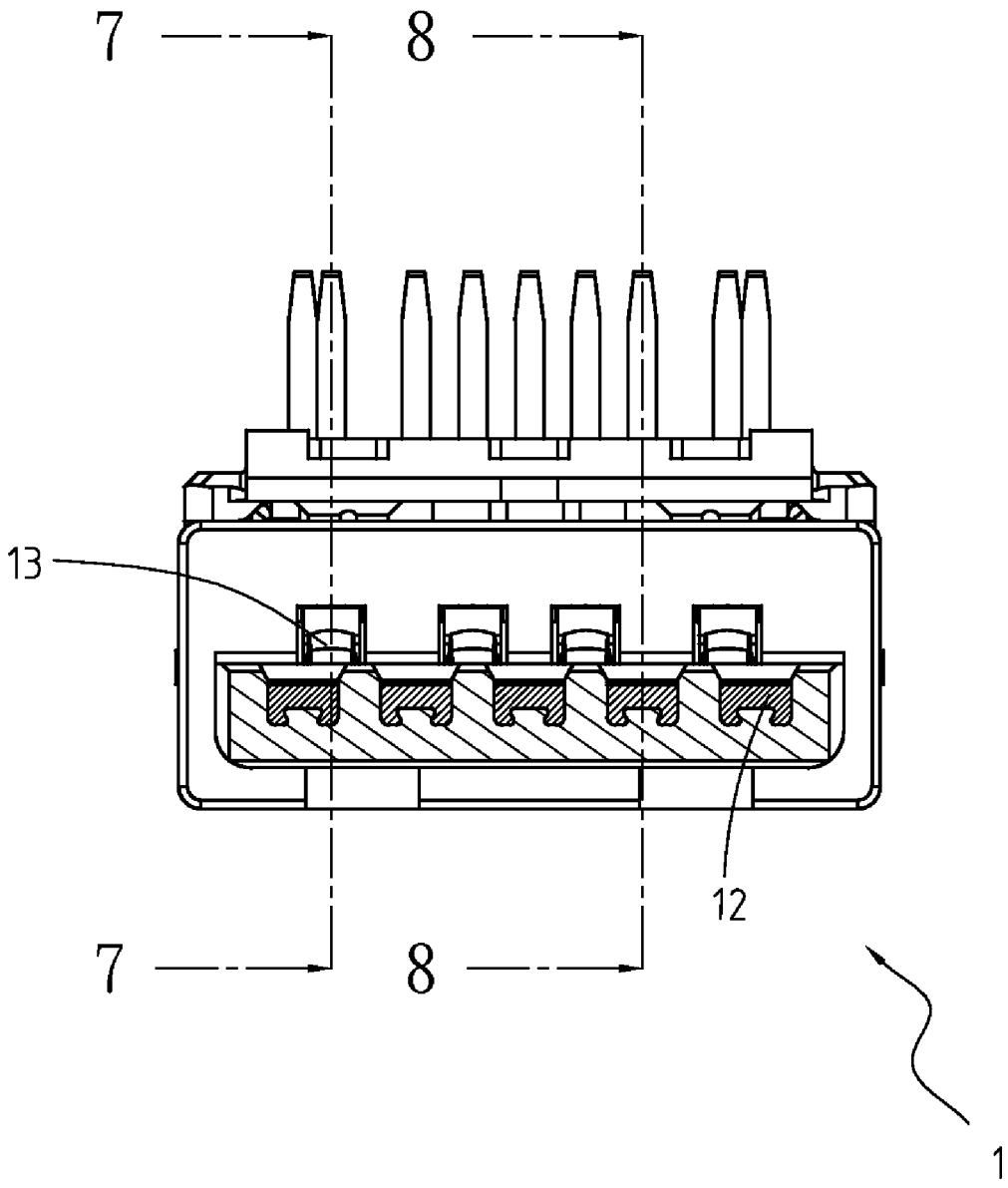
FIG. 6 is a cross sectional front view of the receptacle connector in FIG. 1.
Figure 7:
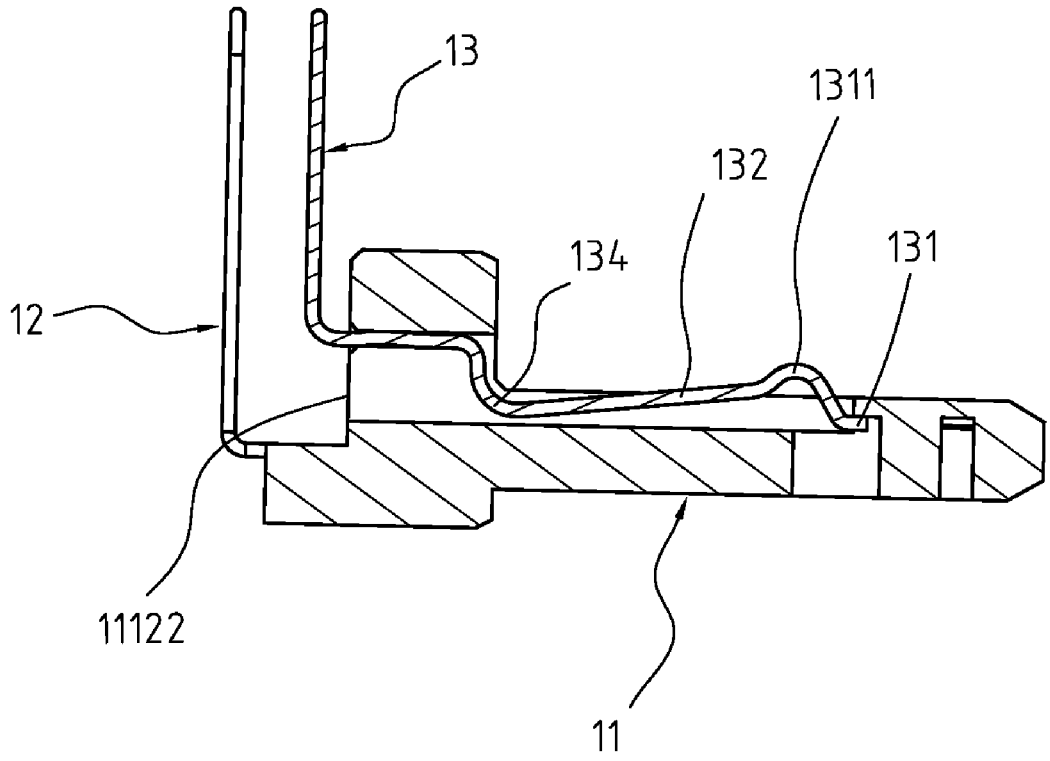
FIG. 7 is a cross sectional side view of a lower insulated housing and first and second contact pins along line 7-7 in FIG. 4.
Figure 8:
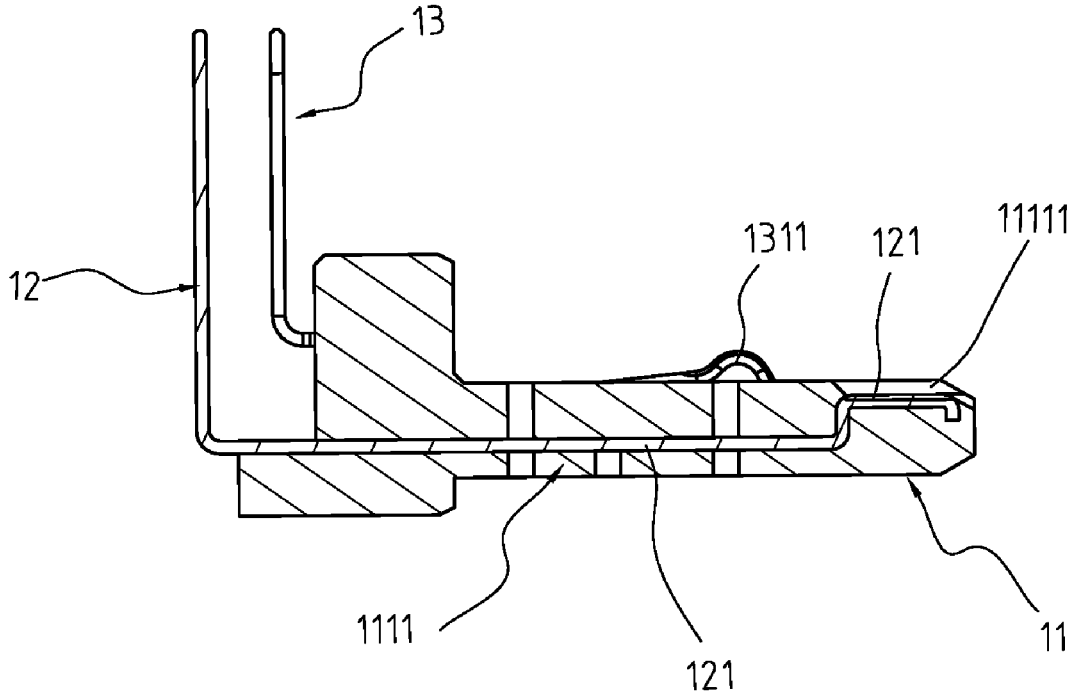
FIG. 8 is a cross sectional side view of a lower insulated housing and first and second contact pins along line 8-8 in FIG. 4.

With further reference to FIG. 3, the upper housing (111) comprises a longitudinal body (1111) and a transverse protrusion (1112). The longitudinal body (1111) has a front end and an inner surface. The transverse protrusion (1112) is formed on the inner surface of the longitudinal body (1111), protrudes down and has a distal edge, two sides, plural mounting holes (11121), four second contact pin holes (11122), plural locking notches (11123) and two alignment notches (11124).

The mounting holes (11121) are formed in the distal edge of the transverse protrusion (1112).

The second contact pin holes (11122) are parallel to the longitudinal body (1111).

The locking notches (11123) are formed respectively on the sides of the transverse protrusion (1112).

The alignment notches (11124) are formed on the transverse protrusion (1112) opposite to the mounting holes (11121).

The inner surface of the upper housing (111) has plural parallel grooves (11111) and plural parallel channels (11112).

The lower housing (112) is connected to the upper housing (111) and comprises a longitudinal body (1121) and a transverse protrusion (1122). The longitudinal body (1121) has an inner surface, is provided with plural first holes (11211), second holes (11212) and an abutting element (11213). The abutting element (11213) mounts on the surface and corresponds to the abutting holes (11121) of the upper housing (111). The transverse protrusion (1122) is formed on the surface of the longitudinal body (1121) and comprises plural terminal passages (11221). The terminal passages (11221) are connected to the second holes (11211) and the second holes (11212).

The first terminal (12) complies with a USB 3.0 interface, comprises a protruded end (121), an elongated portion (122) and a first pin (123) and is insert-molded in the upper housing (111). The protruded end (121) mounts on the grooves (11111) of the upper housing (111). The elongated portion (122) is connected to the protruded end (121), narrower than the protruded end (121) and is embedded in the longitudinal body (1111) of the upper housing (111). The first pin (123) is longitudinal to the elongated portion (122) and passes through the first holes (11211) and the terminal passages (11221).

The second terminal (13) complies with a USB 2.0 interface and comprises a contact (131), a connected portion (132), a second pin (133) and an arch (134), and is insert-molded in the upper housing (111). The connected portion (132) elongates from the contact (131). The second pin (133) is longitudinal from the connected portion (132) and passes through the second holes (11212) and the terminal passages (11221). The arch (134) could reduce an external force resulting from plugging in a plug connector to lower the flexibility of the second terminal (13).

Figure 9:
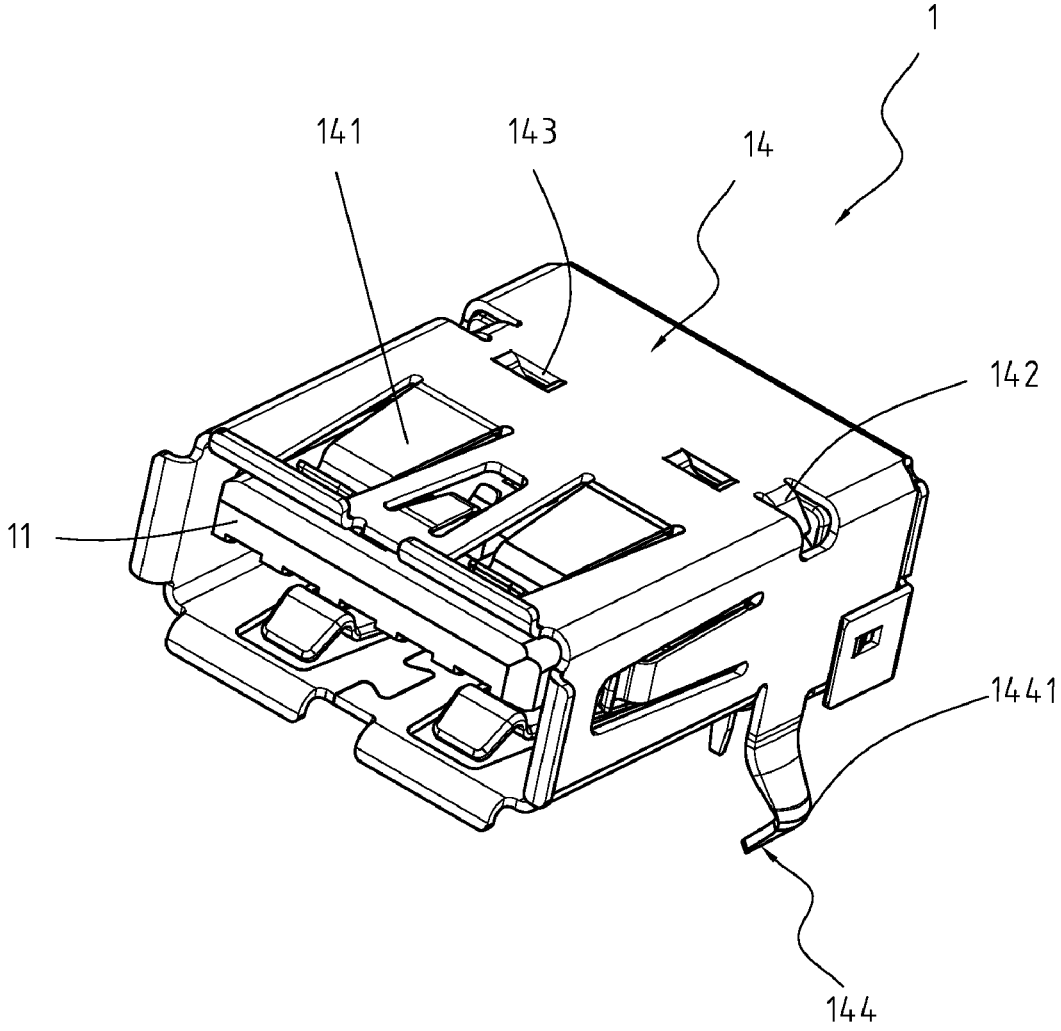
FIG. 9 is a bottom, front perspective view of the receptacle connector in FIG. 1.

With further reference to FIGS. 3 and 9, the metal casing (14) has four sides and comprises a positioned unit (141), a clasping element (142) and two pins (143). The positioned unit (141) contacts the positioned grooves (11123). The clasping element (142) contacts the groove (11124) of the upper housing (111). The pin (143) has a protruding ball (1431) to reduce friction while being mounted on a PCB. The side has a tongue (144) to tightly connect to the insulated housing (11).

What is claimed is:

1. A receptacle connector being mounted on a printed circuit board (PCB) and being connected to a plug connector, comprising an insulated housing comprising an upper housing comprising a longitudinal body, having a surface comprising plural parallel grooves and plural parallel channels; and an extension, being protrudedly mounted on the surface of the longitudinal body, having two sides and comprising plural abutting holes, terminal positioned holes, positioning grooves and two opposite grooves;

a lower housing, being connected to the upper housing and comprising a longitudinal body having a surface and being provided with plural first holes, second holes and abutting element mounts on the surface and corresponding to the abutting holes of the upper housing; and a transverse protrusion, being formed on the surface of the longitudinal body and comprising plural terminal passages connecting to the first holes and the second holes;

plural first contact pins, comprising a protruded end, being mounted on the grooves of the upper housing;

an elongated portion, being connected to the protruded end, being narrower than the protruded end and being embedded in the longitudinal body of the upper housing; and a first pin, longitudinal to the elongated portion and passing through the first holes and the terminal passages;

plural second contact pins, comprising a contact;

a connected portion, elongating form the contact;

a second pin, longitudinal from the elongated portion and passing through the first holes and the terminal passages; and an arch, reducing an external force resulting from plugging in a USB plug connector to lower the flexibility of the second terminal; and a metal casing, mounting around the insulated housing, having four sides and comprising a positioning unit, contacting the positioning grooves of the extension;

a tongue, contacting the groove of the upper housing; and two pins, having a protruding ball.

2. The receptacle connector as claimed as claim 1, wherein the first contact pins complying with a USB 3.0 interface.

3. The receptacle connector as claimed as claim 1, wherein the second contact pins complying with a USB 2.0 interface.

* * * * *